US007588468B2

(12) United States Patent
Biddle et al.

(10) Patent No.: US 7,588,468 B2
(45) Date of Patent: Sep. 15, 2009

(54) ELECTRICAL CONNECTOR WITH IMPROVED PRELOADING STRUCTURE

(75) Inventors: Gary E. Biddle, Carlisle, PA (US); Brian J. Gillespie, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 17 days.

(21) Appl. No.: 11/509,103

(22) Filed: Aug. 24, 2006

(65) Prior Publication Data

US 2008/0050973 A1 Feb. 28, 2008

(51) Int. Cl.
*H01R 24/00* (2006.01)

(52) U.S. Cl. ..... 439/637

(58) Field of Classification Search ..... 439/637, 439/636, 660

See application file for complete search history.

(56) References Cited

U.S. PATENT DOCUMENTS 3,530,422 A * 9/1970 Goodman ..... 439/62
4,087,151 A * 5/1978 Robert et al. ..... 439/188
4,184,735 A * 1/1980 Ammon et al. ..... 439/637
5,041,023 A 8/1991 Lytle
5,052,936 A * 10/1991 Biechler et al. ..... 439/60
5,137,454 A * 8/1992 Baechtle ..... 439/62
5,163,847 A * 11/1992 Regnier ..... 439/157
5,411,408 A * 5/1995 DiViesti et al. ..... 439/326
5,425,658 A * 6/1995 White ..... 439/637
5,609,502 A * 3/1997 Thumma ..... 439/747
5,876,214 A * 3/1999 McHugh et al. ..... 439/60
5,919,049 A * 7/1999 Petersen et al. ..... 439/60
6,102,744 A * 8/2000 Korsunsky et al. ..... 439/637
6,152,777 A * 11/2000 Smith et al. ..... 439/633
6,394,846 B1 5/2002 Belopolsky et al.
6,464,537 B1 * 10/2002 Letourneau et al. ..... 439/608
6,702,619 B2 * 3/2004 Kuroda et al. ..... 439/637
6,997,728 B1 * 2/2006 Chen ..... 439/260
7,238,054 B2 * 7/2007 Higeta et al. ..... 439/637

* cited by examiner

*Primary Examiner*—T C Patel
*Assistant Examiner*—Vladimir Imas
(74) *Attorney, Agent, or Firm*—Wei Te Chung

(57) ABSTRACT

An electrical connector (100) for an electrical card includes an insulating housing (20) defining a receiving slot (220) for mating and a number of electrical contacts (60). Each of the electrical contacts has a securing portion for securing the contact in the housing, a contacting portion (66) extending into the receiving slot and a flexible connecting portion (64) connecting the securing portion and the contacting portion. The insulating housing forms a stop portion (226) flexibly biased by said connecting portion when said electrical card is not mated therein.

11 Claims, 4 Drawing Sheets

ELECTRICAL CONNECTOR WITH IMPROVED PRELOADING STRUCTURE

BACKGROUND OF THE INVENTION

1. Field of the Invention

The present invention relates to an electrical connector having electrical contacts for electrically connecting a daughter card to a mother board, and more particularly, relates to preloading features of the electrical contacts for decreasing an insertion force applied on the electrical component when the electrical component is mated into the electrical connector.

2. Description of the Prior Art

A card edge electrical connector is disclosed with preloading structures in U.S. Pat. No. 5,041,023 issued on Oct. 10, 1995. The electrical connector includes an insulating housing defining a slot for receiving a mating daughter board and a number of electrical contacts lined along two opposite sides of the slot. Each of the electrical contacts includes a securing portion for securing the electrical contact in the housing, a flexible arm extending from the securing portion with a bight interface extending into the slot for electrically contacting the mating daughter board, and an electrical stub sequentially extending above the bight interface for abutting a side wall of the receiving slot. However, in a high speed application, the length of the electrical stub is detrimental to the signal integrity.

Hence, an improved electrical connector is needed to decrease the length of electrical stub above the bight interface and improve the signal integrity.

BRIEF SUMMARY OF THE INVENTION

One object of the present invention is to provide an electrical connector with lower insertion force and improved signal integrity.

An electrical connector comprises an insulating housing and a plurality of electrical contacts. The insulating housing defines a receiving cavity for mating with an mating electrical component therein. Each of said electrical contacts has a securing portion for securing said contact in said housing, a connecting portion extending from said securing portion and a contacting portion extending sequentially from the connection arm into said receiving cavity. The insulating housing forms a stop portion abutting said connecting portion for preventing said contacting portion from further moving into said receiving slot when said mating electrical component is not mated therein. The electrical contact is preloaded on the connecting portion, so that the length of the electrical stub can be shortened to improve the signal integrity.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
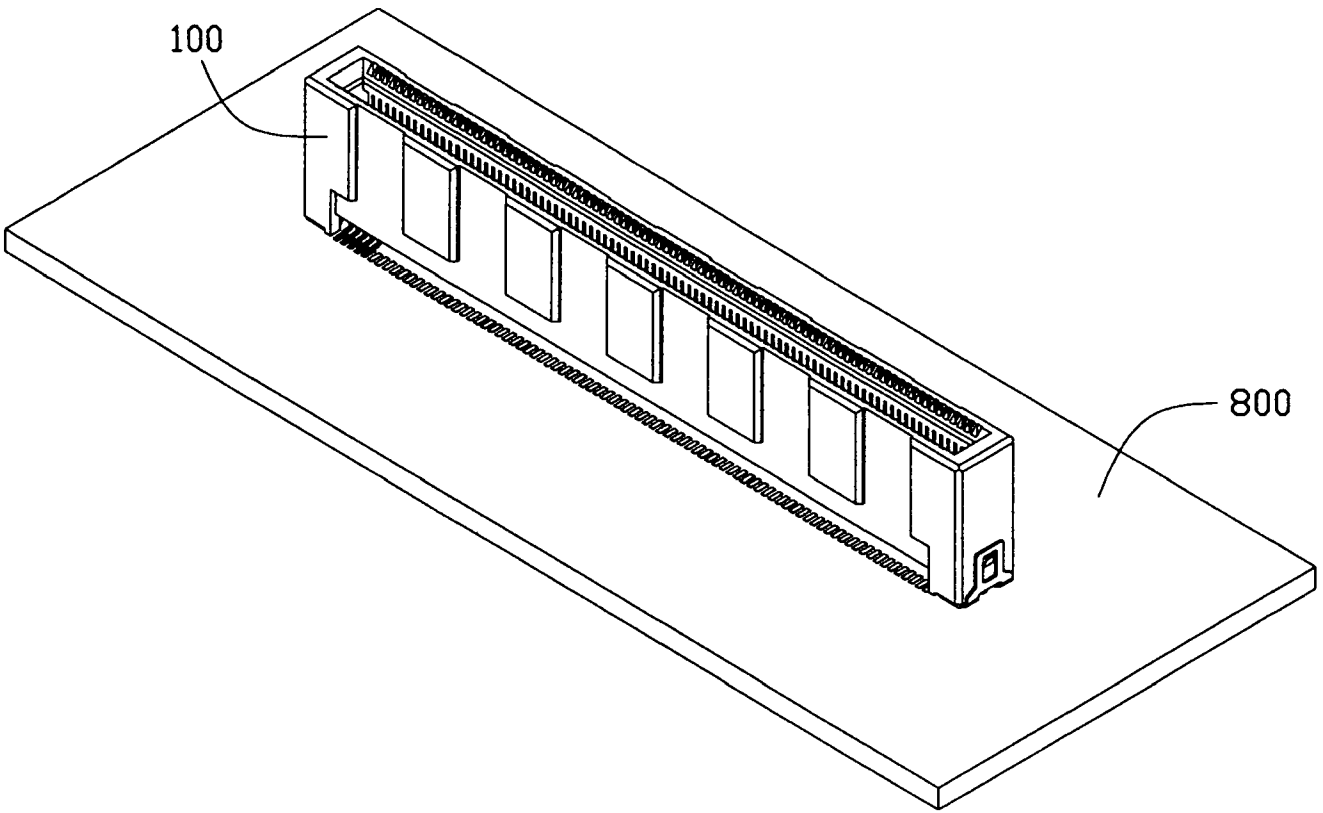
FIG. 1 is a perspective view of an electrical connector according to the present invention.

Reference will now be made to the drawing figures to describe the present invention in detail.

FIG. 1 shows an electrical connector 100 mounted on a mother board 800 according to the present invention. The electrical connector 100 comprises an insulating housing 20 and two contact inserts 40.

Figure 2:
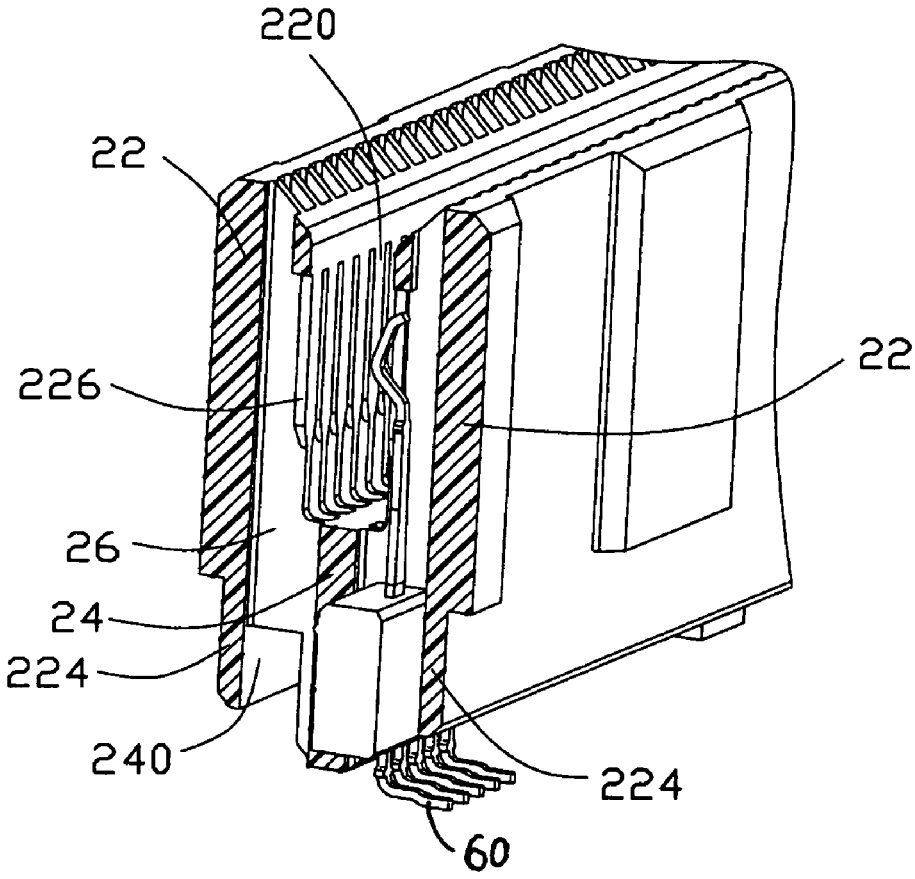
FIG. 2 is a sectional view of the electrical connector shown in FIG. 1 (with a contact insert is omitted for clearly shown)
Figure 3:
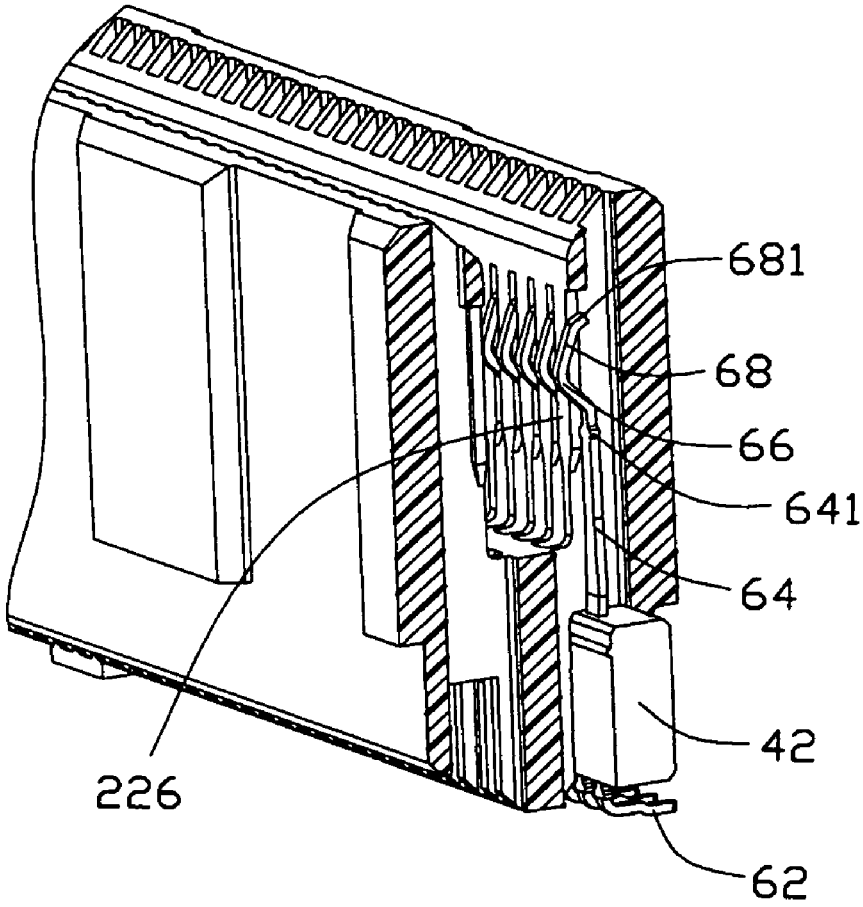
FIG. 3 is another sectional view similar to the FIG. 2.

Referring to FIGS. 2-3, the insulating housing 20 forms a pair of mutual opposite side walls 22 and a bottom wall 24 to define a longitudinal mating slot 220 above the bottom wall 24 for receiving an edge of a daughter card (not shown). The side walls 22 have lower portions 224 aligning with and sandwiching the bottom wall 24. The insulating housing 20 further defines a pair of cavities 240 between lower portions 224 of side wall 22 and the bottom wall 24. Each of the side walls 22 forms a row of contact passageways 26 extending upwardly from corresponding cavity 240 and communicating the receiving slot 220. The contact passageways 26 cut through the side wall 22. The side walls 22 further forms a pair of ribs 226 oppositely protruding into each of the contact passageways 26. The pair of ribs 226 are symmetrically located at an entrance of corresponding contact passageway 26 into the receiving slot 220.

Either of the contact insert 40 includes a insulating bar 42 and a row of electrical contacts 60 having a securing portion (not shown) molded over by the insulating bar 42. Each of the electrical contacts 60 further includes a soldering tail 62 extending downwardly from the securing portion, a connecting portion 64 extending upwardly from the securing portion, a contacting portion 66 extending from an upper end of the connecting portion 64 and a guiding portion 68 extending sequentially upward from the contacting portion 66. The connecting portion 64 forms a flexible straight cantilever received in corresponding contact passageways 26 and a pair of bulges 641 protruding sideway for abutting on corresponding pair of ribs 226. The contacting portion 66 forms a bight interface crooking into the receiving slot 220 for mating with the inserted daughter card. The guiding portion 68 extends above the interface and having a little-length free end 681 slantwise extending into corresponding passageway 26.

Figure 4:
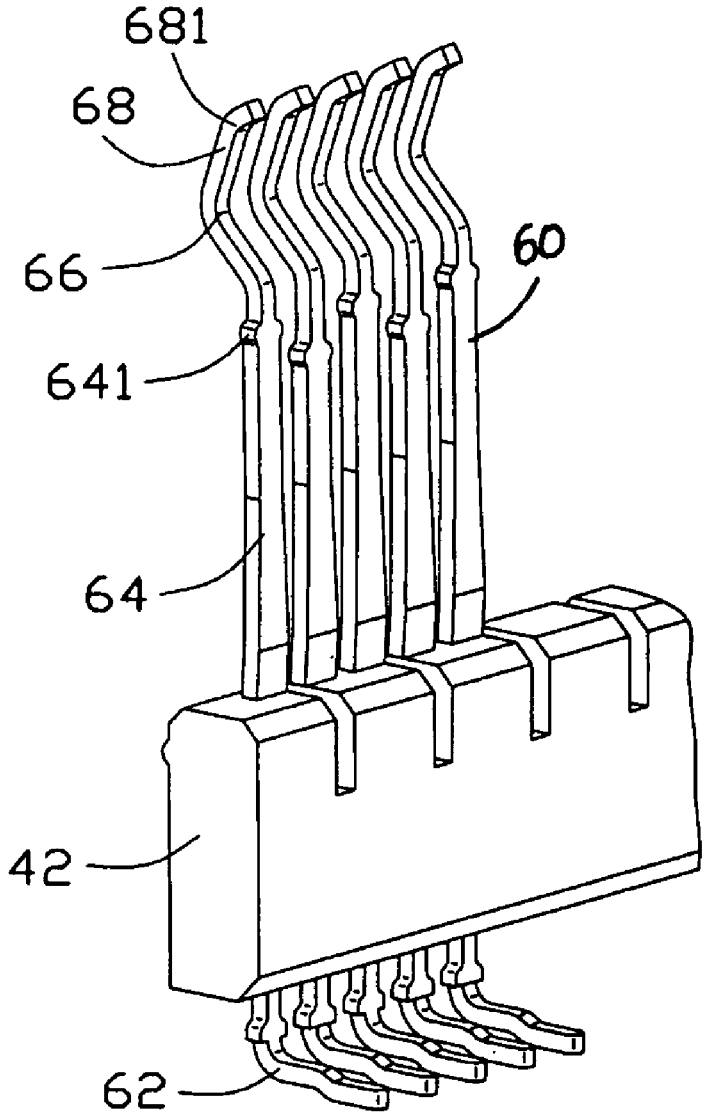
FIG. 4 is partial perspective view of a contact insert with a few of the contacts.

When the daughter card is not mated in the receiving slot 220, the connecting portion 64 flexibly biases the abutting of the bulges 641 of the connecting portion 64 on the ribs 226 of the housing 20. As disclosed in FIG. 4, the bulges 641 of the connecting portion 64 are disposed at different height, so that the capacitance between adjacent bulged 61 decreases comparing to the capacitance when the bulges 641 of the connecting portion 64 were disposed at the same height.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

We claim:

1. An electrical connector adapted for mating with a complementary electrical component comprising:

an insulating housing defining a first side wall and a receiving slot besides said first side wall, said first side wall defining a row of contact passageways communicating with said receiving slot;

a plurality of electrical contacts received in corresponding contact passageways, each of said electrical contacts having a securing portion for securing said contact in said housing, a flexible connection arm extending upwardly in corresponding contact passageway and a contacting portion continuing from the connection arm into said receiving slot;

wherein said insulating housing forms a pair of ribs abutting said connection arm for preventing said contacting portion from further translating into said receiving slot when said mating electrical component is not mated therein;

wherein the housing further comprises an insulating piece separately molded, and wherein said plurality of electrical contacts are inserted-molded into said insulating piece to form an insert;

wherein said insulating housing has a bottom wall having an upper face facing said receiving slot, said first wall having a lower portion aligned to and cooperatively with said bottom wall to define a cavity receiving said insulating piece;

wherein said electrical contacts are disposed in corresponding contact passageways in a row parallel to said first side wall;

said connection arm protruding sidewardly a pair of bulges, the pair of ribs being respectively disposed on opposite sides of a contact passageway for mating with corresponding bulges of the electrical contact, and said pairs of bulges of any two adjacent electrical contacts of said row are disposed at different height a channel being defined between the ribs for the contacting portion to pass through.

2. The electrical connector according to 1, wherein the contacting portion of each electrical contact extends upwardly from corresponding connection arm, said contacting portion forming a bight interface disposed in said receiving slot.

3. The electrical connector according to 2, wherein the electrical contact has a free end upwardly extending from said contacting portion, partially received in corresponding contact passageway when said complementary electrical component is not mated therein.

4. An electrical connector comprising:

an insulating housing defining a receiving cavity for mating with an mating electrical component therein;

a plurality of electrical contacts, each of said electrical contacts having a securing portion for securing said contact in said housing; a connecting portion extending from said securing portion and a contacting portion extending sequentially from the connecting portion;

wherein said insulating housing forms a stop portion biased flexibly by said connecting portion when said mating electrical component is not mated therein;

wherein said stop portion of said insulating housing includes a pair of ribs respectively disposed on opposite sides of corresponding contact passageways, said connecting portion forms a pair of bulges flexibly abutting said ribs, a channel being defined between the ribs so tat the contacting portion can pass there through;

wherein said electrical contacts are arranged in a row and said bulges of any two adjacent electrical contacts are disposed at different heights.

5. The electrical connector according to 4, wherein the housing further comprises an insulating piece separately molded, and wherein said plurality of electrical contacts are inserted-molded into said insulating piece to form an insert.

6. An electrical connector comprising:

an insulating housing defining therein a slot along a longitudinal direction and a plurality of juxtaposed passageways located beside said slot and arranged along said longitudinal direction of the housing, said passageways commonly facing a slot in a transverse direction perpendicular to said longitudinal direction;

a stopper structure formed on the housing between each of said passageways and said slot in said transverse direction;

a plurality of electrical contacts disposed in corresponding contact passageways respectively, each of said electrical contacts including:

a securing section for securing said contact in position with regard to the housing;

a contacting section extending into the slot in said transverse direction for coupling to an electronic part received in the slot; and a bulge section located between the securing section and the contacting section and extending laterally along said longitudinal direction to abut against the stopper in said transverse direction so that the contact experiences a preloaded manner before the electronic part is received in the slot.

7. The electrical connector according to 6, wherein said stopper is a rib formed on an interface between the passageway and the slot.

8. The electrical connector according to 6, wherein the bulge sections of the neighboring contacts are offset from each other along an extension direction of a contact arm of each of said contacts.

9. The electrical connector according to 7, wherein said rib does not extend through the whole interface along an extension direction of the corresponding slot.

10. The electrical connector according to 6, wherein the contacts are integrally formed in an insulator.

11. The electrical connector according to 10, wherein said insulator is disposed in the housing.

* * * * *